US008663427B2

(12) United States Patent
Sealey et al.

(10) Patent No.: US 8,663,427 B2
(45) Date of Patent: Mar. 4, 2014

(54) ADDITION OF ENDOTHERMIC FIRE RETARDANTS TO PROVIDE NEAR NEUTRAL PH PULP FIBER WEBS

(75) Inventors: James E. Sealey, Loveland, OH (US); Brent A. Fields, Trenton, OH (US)

(73) Assignee: International Paper Company, Memphis, TN (US)

( * ) Notice: Subject to any disclaimer, the term of this patent is extended or adjusted under 35 U.S.C. 154(b) by 103 days.

(21) Appl. No.: 13/081,759

(22) Filed: Apr. 7, 2011

(65) Prior Publication Data

US 2012/0255695 A1 Oct. 11, 2012

(51) Int. Cl.

| | |
|---|---|
| ***D21H 17/66*** | (2006.01) |
| ***D21H 21/34*** | (2006.01) |
| ***C09K 21/02*** | (2006.01) |

(52) U.S. Cl.

USPC ..... 162/181.3; 162/158; 162/159; 162/181.1; 162/181.2; 162/181.4; 162/181.5; 162/181.6; 162/183; 162/184; 106/18.11; 106/18.13; 106/18.14; 106/18.24; 106/18.26; 252/607

(58) Field of Classification Search

USPC ..... 162/70, 77, 80, 90, 158, 159, 162/181.1–181.2, 181.4–181.7, 183–185; 106/15.05, 18.11–18.14, 18.24, 18.26, 106/18.35; 8/115.51, 188; 252/607, 608

See application file for complete search history.

(56) References Cited

U.S. PATENT DOCUMENTS

| | | | |
|---|---|---|---|
| 1,382,618 | A | 6/1921 | Blenio |
| 2,654,295 | A | 10/1953 | Sutherland |
| 2,832,745 | A | 4/1958 | Hechenblefkner |
| 2,982,482 | A | 5/1961 | Curtis |
| 3,049,307 | A | 8/1962 | Dalzell, Jr. |
| 3,591,450 | A | 7/1971 | Murphy et al. |
| 3,815,834 | A | 6/1974 | Gilbert |
| 3,900,327 | A | 8/1975 | Miller |
| 3,955,032 | A | 5/1976 | Mischutin |
| 3,972,092 | A | 8/1976 | Wood |

(Continued)

FOREIGN PATENT DOCUMENTS

| | | |
|---|---|---|
| EP | 0132128 | 1/1985 |
| GB | 2209352 | 5/1989 |

(Continued)

OTHER PUBLICATIONS

Smook Handbook, p. 336, p. 75-84, p. 342, p. 289-92, p. 283-85, 1992.

(Continued)

*Primary Examiner* — Mark Halpern
*Assistant Examiner* — Dennis Cordray
(74) *Attorney, Agent, or Firm* — Thomas W. Barnes, III; Eric W. Guttag

(57) ABSTRACT

A process in which an at least partially delignified pulp fiber web having a Kappa number of less than about 130 is treated with an aqueous endothermic fire retardant solution having a pH of about 10 or less. The treated pulp fiber web has a near neutral pH of from about 5 to about 9, and is treated with at least about 20 lbs of endothermic fire retardants per ton of the pulp fiber web, with at least about 5% of the total amount of endothermic fire retardants being added at a point prior to when the pulp fiber web is formed. Also a fire resistant pulp fiber web having a near neutral pH.

21 Claims, 2 Drawing Sheets

(56) References Cited

U.S. PATENT DOCUMENTS

| | | | | | |
|---|---|---|---|---|---|
| 4,022,965 | A | | 5/1977 | Goheen et al. | |
| 4,026,808 | A | | 5/1977 | Duffy | |
| 4,060,450 | A | * | 11/1977 | Palazzolo et al. | 162/141 |
| 4,065,347 | A | | 12/1977 | Aberg et al. | |
| 4,075,136 | A | | 2/1978 | Schaper | |
| 4,081,316 | A | | 3/1978 | Aberg et al. | |
| 4,118,531 | A | | 10/1978 | Hauser | |
| 4,166,894 | A | | 9/1979 | Schaper | |
| 4,168,175 | A | | 9/1979 | Shutt | |
| 4,174,417 | A | | 11/1979 | Rydell | |
| 4,184,969 | A | | 1/1980 | Bhat | |
| 4,212,675 | A | | 7/1980 | Robinson | |
| 4,394,413 | A | | 7/1983 | Westhead | |
| 4,425,186 | A | | 1/1984 | May et al. | |
| 4,431,481 | A | | 2/1984 | Drach et al. | |
| 4,496,427 | A | | 1/1985 | Davison | |
| 4,595,414 | A | | 6/1986 | Shutt | |
| 4,600,606 | A | | 7/1986 | Mitchutin | |
| 4,602,982 | A | * | 7/1986 | Samuelson | 162/40 |
| 4,702,861 | A | | 10/1987 | Farnum | |
| 4,725,382 | A | | 2/1988 | Lewchalermwong | |
| 4,986,882 | A | | 1/1991 | Mackey et al. | |
| 5,011,091 | A | | 4/1991 | Kopecky | |
| 5,049,235 | A | | 9/1991 | Barcus et al. | |
| 5,064,710 | A | | 11/1991 | Gosz | |
| 5,076,969 | A | | 12/1991 | Fox | |
| 5,155,964 | A | | 10/1992 | Fortin et al. | |
| 5,160,789 | A | | 11/1992 | Barcus et al. | |
| 5,209,953 | A | | 5/1993 | Grupe et al. | |
| 5,252,754 | A | * | 10/1993 | Bottorff | 549/328 |
| 5,262,005 | A | | 11/1993 | Eriksson et al. | |
| 5,266,250 | A | | 11/1993 | Kroyer | |
| 5,272,852 | A | | 12/1993 | Fortin et al. | |
| 5,328,759 | A | | 7/1994 | McCormack et al. | |
| 5,360,420 | A | | 11/1994 | Cook et al. | |
| 5,405,555 | A | * | 4/1995 | Riker | 252/607 |
| 5,443,899 | A | | 8/1995 | Barcus et al. | |
| 5,491,186 | A | | 2/1996 | Kean et al. | |
| 5,516,580 | A | | 5/1996 | Frenette et al. | |
| 5,531,728 | A | | 7/1996 | Lash | |
| 5,534,301 | A | | 7/1996 | Shutt | |
| 5,554,238 | A | | 9/1996 | English | |
| 5,642,601 | A | | 7/1997 | Thompson, Jr. et al. | |
| 5,662,773 | A | | 9/1997 | Frederick et al. | |
| 5,667,637 | A | | 9/1997 | Jewell et al. | |
| 5,698,074 | A | | 12/1997 | Barcus et al. | |
| 5,698,688 | A | | 12/1997 | Smith et al. | |
| H1704 | H | | 1/1998 | Wallajapet et al. | |
| 5,723,020 | A | | 3/1998 | Robinson et al. | |
| 5,731,080 | A | | 3/1998 | Cousin et al. | |
| 5,786,059 | A | | 7/1998 | Frank et al. | |
| 5,858,530 | A | | 1/1999 | McCullough, Jr. | |
| 5,886,306 | A | | 3/1999 | Patel et al. | |
| 5,910,367 | A | | 6/1999 | Kean et al. | |
| 5,935,880 | A | | 8/1999 | Wang et al. | |
| 5,990,377 | A | | 11/1999 | Chen et al. | |
| 6,025,027 | A | | 2/2000 | Shutt | |
| 6,059,924 | A | | 5/2000 | Hoskins | |
| 6,146,494 | A | | 11/2000 | Seger et al. | |
| 6,162,329 | A | * | 12/2000 | Vinson et al. | 162/158 |
| 6,361,651 | B1 | | 3/2002 | Sun | |
| 6,372,360 | B1 | | 4/2002 | Blunden et al. | |
| 6,471,824 | B1 | | 10/2002 | Jewell | |
| 6,506,282 | B2 | | 1/2003 | Hu et al. | |
| 6,579,414 | B2 | | 6/2003 | Jewell | |
| 6,579,415 | B2 | | 6/2003 | Jewell | |
| 6,582,557 | B2 | | 6/2003 | Jewell | |
| 6,589,643 | B2 | | 7/2003 | Okada et al. | |
| 6,592,712 | B2 | | 7/2003 | Koukoulas et al. | |
| 6,592,717 | B2 | | 7/2003 | Jewell | |
| 6,719,862 | B2 | | 4/2004 | Quick et al. | |
| 6,733,697 | B2 | | 5/2004 | Rhodes et al. | |
| 6,808,790 | B2 | | 10/2004 | Chen et al. | |
| 6,867,154 | B1 | | 3/2005 | Lunsford et al. | |
| 6,982,049 | B1 | | 1/2006 | Mabey et al. | |
| 6,989,113 | B1 | | 1/2006 | Mabey et al. | |
| 7,144,474 | B1 | | 12/2006 | Hansen et al. | |
| 7,381,300 | B2 | | 6/2008 | Skaggs et al. | |
| 7,549,853 | B2 | | 6/2009 | Fegelman et al. | |
| 7,604,715 | B2 | | 10/2009 | Liesen et al. | |
| 7,622,517 | B2 | | 11/2009 | Bauer et al. | |
| 7,638,016 | B2 | | 12/2009 | Nguyen | |
| 7,674,522 | B2 | | 3/2010 | Pohlmann | |
| 7,744,143 | B2 | | 6/2010 | Gladfelter et al. | |
| 7,837,009 | B2 | | 11/2010 | Gross et al. | |
| 8,043,384 | B2 | | 10/2011 | Gagnon et al. | |
| 8,388,807 | B2 | | 3/2013 | Sealey et al. | |
| 8,535,482 | B2 | | 9/2013 | Jiang et al. | |
| 2002/0099347 | A1 | | 7/2002 | Chen et al. | |
| 2003/0070780 | A1 | | 4/2003 | Chen et al. | |
| 2004/0099178 | A1 | | 5/2004 | Jones et al. | |
| 2006/0185808 | A1 | | 8/2006 | Nguyen | |
| 2007/0202771 | A1 | | 8/2007 | Douglass et al. | |
| 2007/0209307 | A1 | | 9/2007 | Andersen | |
| 2008/0050565 | A1 | | 2/2008 | Gross et al. | |
| 2008/0121461 | A1 | * | 5/2008 | Gross et al. | 181/286 |
| 2008/0211253 | A1 | | 9/2008 | Gladfelter et al. | |
| 2009/0068430 | A1 | * | 3/2009 | Troger et al. | 428/218 |
| 2009/0176074 | A1 | | 7/2009 | Sotendahl et al. | |
| 2010/0066121 | A1 | | 3/2010 | Gross | |
| 2010/0168286 | A1 | | 7/2010 | Gladfelter et al. | |
| 2010/0252213 | A1 | | 10/2010 | Nguyen | |
| 2011/0034891 | A1 | | 2/2011 | Jiang et al. | |
| 2011/0095245 | A1 | | 4/2011 | Munson et al. | |
| 2011/0117354 | A1 | | 5/2011 | Gagnon et al. | |
| 2012/0048493 | A1 | | 3/2012 | Sealey | |
| 2012/0199303 | A1 | | 8/2012 | Sealey et al. | |
| 2013/0133850 | A1 | | 5/2013 | Sealey et al. | |

FOREIGN PATENT DOCUMENTS

| | | |
|---|---|---|
| WO | 8908137 | 9/1989 |
| WO | 9304239 | 3/1993 |
| WO | 9412725 | 6/1994 |
| WO | 9632459 | 10/1996 |
| WO | 0236517 | 5/2002 |
| WO | 2005012638 | 2/2005 |
| WO | 2005042859 | 5/2005 |
| WO | 20050274472 | 12/2005 |
| WO | 2006107847 | 10/2006 |
| WO | 2008005936 | 1/2008 |
| WO | 2012018749 | 2/2012 |

OTHER PUBLICATIONS

Flame Retardants for Plastics and texiles, Weil, et al, Hanser Publishers, Munich 2009, p. 4-8.

Hydromagnesite—Mg5 (Co3) 4 (OH) 2-4H20, 2005.

Huntite—CaMg3 (Co3)4, 2005.

* cited by examiner

ADDITION OF ENDOTHERMIC FIRE RETARDANTS TO PROVIDE NEAR NEUTRAL PH PULP FIBER WEBS

FIELD OF THE INVENTION

The present invention broadly relates to a process for treating a partially delignified pulp fiber web with an aqueous endothermic fire retardant solution having a pH of about 10 or less, wherein at least about 5% of the total amount of endothermic fire retardants are added at a point prior to when the pulp fiber web is formed to provide a treated pulp fiber web having a near neutral pH (i.e., from about 5 to about 9). The present invention also broadly relates to a fire resistant pulp fiber web having a near neutral pH and comprising a partially delignified pulp fiber web; and a fire retardant component present in and/or on the pulp fiber web, wherein the fire retardant component comprises at least about 10% by weight of the fire retardant component of one or more endothermic fire retardants.

BACKGROUND

Fire resistant fibrous materials may be used in upholstery, cushions, mattress ticking, panel fabric, padding, bedding, insulation, materials for parts in devices or appliances, etc. Such materials may be formed from natural and/or synthetic fibers, and then treated with fire retardant chemicals which may include halogen-based and/or phosphorous-based chemicals, along with certain metal oxides such as ferric oxide, stannic oxide, antimony trioxide, titanium dioxide, etc. These fire resistant materials may be produced by depositing these metal oxides, within or on the fibers, for example, by the successive precipitation of ferric oxides and a mixture of tungstic acid and stannic oxide, by the successive deposition of antimony trioxide and stannic oxide, by the successive deposition of antimony trioxide and titanium dioxide. In another process for imparting fire retardancy to such materials, a single processing bath may be used wherein a dispersion of a chlorinated hydrocarbon and finely divided antimony oxide is padded on the fabric material. Near the fibrous material's combustion temperature, the antimony oxide reacts with hydrogen chloride (generated by degradation of the chlorinated hydrocarbon) to form antimony oxychloride which acts to suppress the flame.

In another process for making such fibrous materials semi-permanently to permanently fire resistant, the fire retardant chemicals may be reacted with the cellulose or protein functionalities of the natural fibers in the material. For example, the cellulose in the fabric fibers may be esterified with diammonium hydrogen orthophosphate. Alternatively, amidophosphates may be reacted with trimethylol melamine to form a thermosetting resin within the fibrous materials (see U.S. Pat. No. 2,832,745 (Hechenblefkner), issued Apr. 29, 1958) or a phosphorous containing N-hydroxy-methyl amide and tetrakis(hydroxymethyl)phosphonium chloride may be incorporated in the fibrous materials by thermal induced pad curing (see U.S. Pat. No. 4,026,808 (Duffy), issued May 31, 1977).

Fire retardant chemicals may also be coated onto the fibrous materials. See, for example, U.S. Pat. No. 3,955,032 (Mischutin), issued May 4, 1976, which discloses a process using chlorinated-cyclopentadieno compounds and chlorobrominated-cyclpentadieno compounds, either alone or in combination with metal oxides, which are suspended in a latex medium and then cured to render natural and synthetic fibrous materials and blends of thereof fire retardant. See also U.S. Pat. No. 4,600,606 (Mischutin), issued Jul. 15, 1986, which discloses a method for flame retarding textile and related fibrous materials which uses a water-insoluble, non-phosphorous containing brominated aromatic or cycloaliphatic compounds along with a metal oxide to treat fabrics for protection against splashes of molten metals or glass, as well as a U.S. Pat. No. 4,702,861 (Farnum), issued Oct. 27, 1987, which discloses a flame retardant composition comprising a dispersion of phosphorous-containing compounds and metal oxides in latex which, upon exposure to elevated temperatures and/or flame, reportedly creates a substantially continuous protective film generally encapsulating and/or enveloping the surface of the article onto which it is applied, the film-forming materials being based upon an aqueous latex dispersion of polyvinylchloride-acrylic copolymer, which is inherently fire retardant.

SUMMARY

According to a first broad aspect of the present invention, there is provided a process comprising the following steps:

a. providing an at least partially delignified pulp fiber web having a Kappa number of less than about 130; and b. treating the at least partially delignified pulp fiber web with an aqueous endothermic fire retardant solution having a pH of about 10 or less and comprising at least about 10% of one or more endothermic fire retardants based on the solids in the solution;

wherein the pulp fiber web treated with the endothermic fire retardant solution has a pH of from about 5 to about 9, wherein the pulp fiber web is treated with a total amount of endothermic fire retardants of at least about 20 lbs of endothermic fire retardants per ton of the pulp fiber web, and wherein at least about 5% of the total amount of endothermic fire retardants are added at a point prior to when the pulp fiber web is formed.

According to a second broad aspect of the present invention, there is provided an article comprising a fire resistant pulp fiber web having a pH of from about 5 to about 9, and comprising:

an at least partially delignified pulp fiber web having a Kappa number of less than about 130; and a fire retardant component present in and/or on the pulp fiber web in an amount of at least about 20 lbs fire retardant component per ton of the pulp fiber web, the fire retardant component comprising:

at least about 10% by weight of the fire retardant component of one or more endothermic fire retardants; and up to about 90% by weight of the fire retardant component of one or more other fire retardants; and one or more fire retardant distributing surfactants in an amount sufficient to distribute the fire retardant component in and/or on the pulp fiber web;

wherein the fire retardant component is in an amount and is distributed in and/or on the pulp fiber web in a manner so that the fire resistant pulp fiber web passes one or more of the following tests: the UL 94 HBF test, the Horizontal Burn Through test, or the ASTM D 5132-04 test.

BRIEF DESCRIPTION OF THE DRAWINGS

The invention will be described in conjunction with the accompanying drawings, in which.

DETAILED DESCRIPTION

Figure 1:
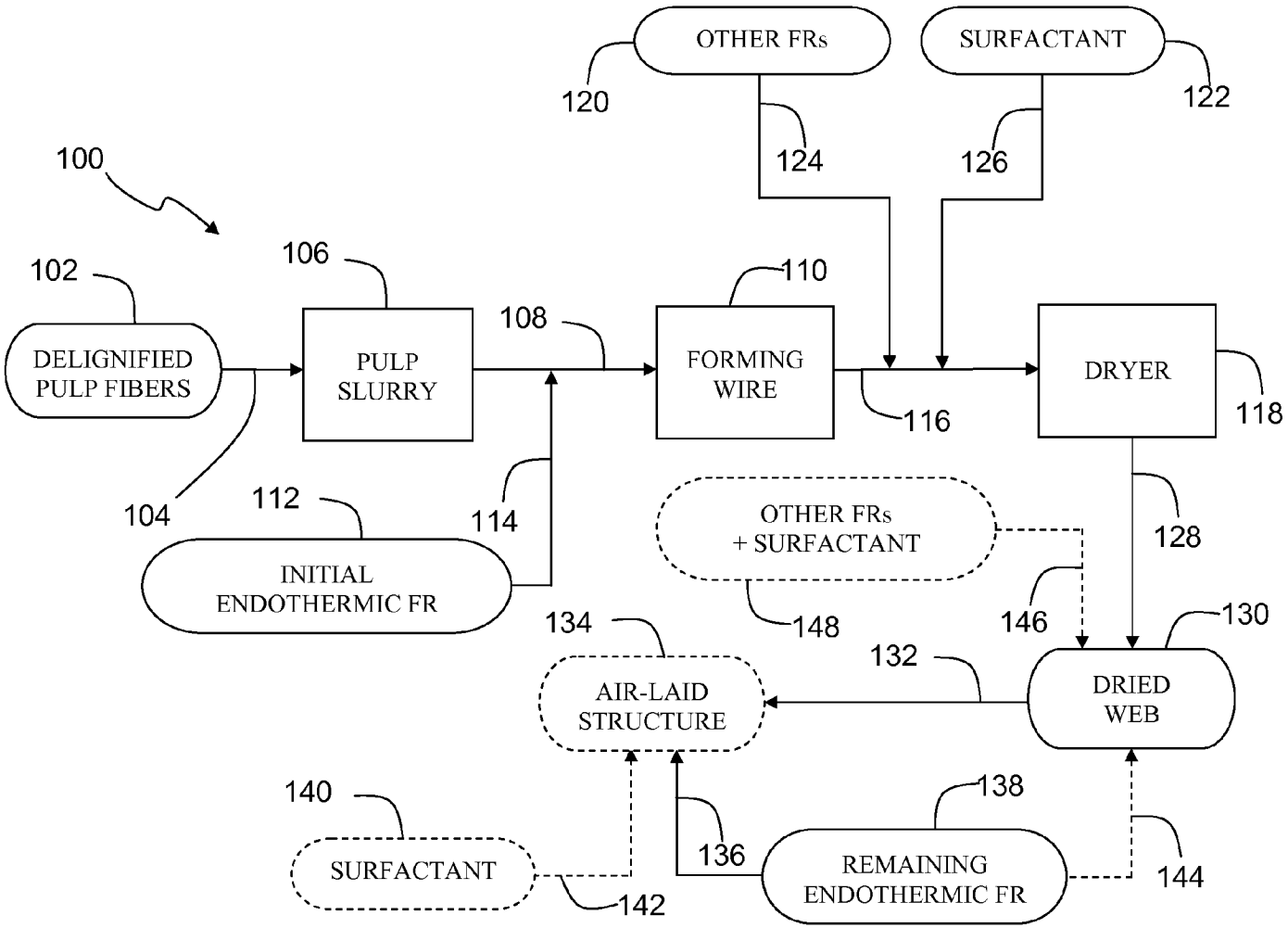
FIG. 1 is a schematic diagram which shows an illustrative process for providing a fire resistant pulp fiber web having a near neutral pH according to an embodiment of the present invention.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top," "bottom," "upper," "lower," "side," "front," "frontal," "forward," "rear," "rearward," "back," "trailing," "above", "below," "left," "right," "horizontal," "vertical," "upward," "downward," etc. are merely used for convenience in describing the various embodiments of the present invention. The embodiments shown in FIGS. 1 through 2 may be flipped over, rotated by 90° in any direction, etc.

For the purposes of the present invention, the term "pulp fibers" refers to a wood pulp fibers which may be softwood pulp fibers, hardwood pulp fibers or a mixture of softwood and hardwood pulp fibers. The pulp fiber web may be in the form of, for example, sheets, strips, pieces, batts/battings, blankets, etc., which may be in the form of a continuous roll, a discrete sheet, etc.

For the purposes of the present invention, the term "fluff pulp" refers to pulp fibers which may be comminuted to provide an air-laid fibrous structure. Fluff pulps may also be referred to as "fluffy pulp," or "comminution pulp." Some illustrative examples of commercially available fluff pulp may include one or more of: RW Supersoft™, Supersoft L™, RW Supersoft Plus™, GT Supersoft Plus™, RW Fluff LITE™, RW Fluff 110™, RW Fluff 150™, RW Fluff 160™, GP 4881™, GT Pulp™, RW SSP™, GP 4825™, etc.

For the purposes of the present invention, the term "pulp fiber web" refers to a fibrous cellulosic matrix comprising wood pulp fibers. Pulp fiber webs may be in the form of, for example, sheets, strips, pieces, batts/battings, blankets, etc., which may be in the form of a continuous roll, a discrete sheet, etc.

For the purposes of the present invention, the term "softwood pulp fibers" refers to fibrous pulps derived from the woody substance of coniferous trees (gymnosperms) such as varieties of fir, spruce, pine, etc., for example, loblolly pine, slash pine, Colorado spruce, balsam fir, Douglas fir, jack pine, radiata pine, white spruce, lodgepole pine, redwood, etc. North American southern softwoods and northern softwoods may be used to provide softwood fibers, as well as softwoods from other regions of the world.

For the purposes of the present invention, the term "hardwood pulp fibers" refers to fibrous pulps derived from the woody substance of deciduous trees (angiosperms) such as birch, oak, beech, maple, eucalyptus, poplars, etc.

For the purposes of the present invention, the term "at least partially delignified pulp fibers" refers to pulp fibers which have been subjected to chemical and/or mechanical processing (e.g., kraft pulping processes) to at least partially remove lignin from the pulp fibers so that the pulp fibers have a Kappa number (also referred to as "K number") of about 130 or less, such as about 50 or less (e.g., about 35 or less). Kappa numbers may be determined by the ISO 302:2004 method. See G. A. Smook, Handbook for Pulp and Paper Technologists ($2^{nd}$ Edition, 1992), page 336, the entire contents and disclosure of which is herein incorporated by reference, for a general description of Kappa Numbers, how to measure Kappa numbers, and how Kappa numbers relate to the lignin content of pulp fibers. See also G. A. Smook, Handbook for Pulp and Paper Technologists ($2^{nd}$ Edition, 1992), pages 75-84, the entire contents and disclosure of which is herein incorporated by reference, for a general description of kraft pulping processes for carrying out delignification of pulp fibers.

For the purposes of the present invention, the term "basis weight," refers to the grammage of the pulp fibers, pulp web, etc., as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight.

For the purposes of the present invention, the term "basis weight variability," refers to the statistical variation from the target basis weight value. For example, if the target basis weight is 750 gsm and the area of the sample being evaluated is 755 gsm, the basis weight variability would be 0.06%. Basis weight variability may be measured in the machine direction (MD) or the cross machine direction (CD).

For the purposes of the present invention, the term "caliper," refers to the thickness of a web (e.g., pulp fiber web) in mils, as determined by measuring the distance between smooth, flat plates at a defined pressure.

For the purposes of the present invention, the term "moisture content," refers to the amount of water present in the pulp fiber web as measured by TAPPI test T210 cm-03.

For the purposes of the present invention, the term "fiberization energy," (also sometimes called the "shred energy") refers to the amount of energy (in kJ/kg) required to comminute (e.g., defiberize, disintegrate, shred, fragment, etc.) a pulp fiber web to individualized pulp fibers by using a hammermill (such as a Kamas Type H 01 Laboratory Defribrator manufactured by Kamas Industri AB). The energy required to comminute the pulp web is normally measured and displayed by the hammermill in, for example, watt hours (wH). The fiberization energy may be calculated by using the following equation: fiberization energy (in kJ/kg)=3600× energy measured (in wH)÷ fiberized fiber weight (in grams). See U.S. Pat. No. 6,719,862 (Quick et al.), issued Apr. 13, 2004, the entire contents and disclosure of which is incorporated by reference, especially column 11, lines 25-32.

For the purposes of the present invention, the term "pulp filler" refers commonly to mineral products (e.g., calcium carbonate, kaolin clay, calcium sulfate hemihydrate, calcium sulfate dehydrate, chalk, etc.) which may be used in pulp fiber web making to reduce materials cost per unit mass of the web, increase opacity, etc. These mineral products may be finely divided, for example, in the size range of from about 0.5 to about 5 microns.

For the purposes of the present invention, the term "pulp pigment" refers to a material (e.g., a finely divided particulate matter) which may be used or may be intended to be used to affect optical properties of the pulp fiber web. Pulp pigments may include one or more of: calcium carbonate, kaolin clay, calcined clay, modified calcined clay, aluminum trihydrate, titanium dioxide, talc, plastic pigment, amorphous silica, aluminum silicate, zeolite, aluminum oxide, colloidal silica, colloidal alumina slurry, etc.

For the purposes of the present invention, the term "calcium carbonate" refers various calcium carbonates which may be used as pulp pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a pulp pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "pulp binders" refers to a binder agent for pulp fibers which may be used to improve the binding strength of the pulp fibers in the web. Suitable pulp binders may include one or more synthetic or naturally occurring polymers (or a combination of different polymers), for example, a polyvinyl alcohol (PVOH), polyacrylamide, modified polyacrylamide, starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, wet strength resins such as Amres (a Kymene type), Bayer Parez, etc., polychloride emulsions, polyols, polyol carbonyl adducts, ethanedial/polyol condensates, polyamides, epichlorohydrin, glyoxal, glyoxal ureas, aliphatic polyisocyanates, 1,6 hexamethylene diisocyanates, polyesters, polyester resins, etc.

For the purposes of the present invention, the term "air-laid fibrous structure" refers to a nonwoven, bulky, porous, soft, fibrous structure obtained by air-laying comminuted pulp fiber webs and/or pulp fibers, and which may optionally comprise synthetic fibers such as bicomponent fibers. Air-laid fibrous structures may include air-laid fibrous cores, air-laid fibrous layers, etc.

For the purposes of the present invention, the term "comminuting" refers to defibrizing, disintegrating, shredding, fragmenting, etc., a pulp fiber web and/or pulp fibers to provide an air-laid fibrous structure.

For the purposes of the present invention, the term "synthetic fibers" refers to fibers other than wood pulp fibers (e.g., other than pulp fibers) and which be made from, for example, cellulose acetate, acrylic, polyamides (such as, for example, Nylon 6, Nylon 6/6, Nylon 12, polyaspartic acid, polyglutamic acid, etc.), polyamines, polyimides, polyamides, polyacrylics (such as, for example, polyacrylamide, polyacrylonitrile, esters of methacrylic acid and acrylic acid, etc.), polycarbonates (such as, for example, polybisphenol A carbonate, polypropylene carbonate, etc.), polydienes (such as, for example, polybutadiene, polyisoprene, polynorbornene, etc.), polyepoxides, polyesters (such as, for example, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, etc.), polyethers (such as, for example, polyethylene glycol(polyethylene oxide), polybutylene glycol, polypropylene oxide, polyoxymethylene(paraformaldehyde), polytetramethylene ether(polytetrahydrofuran), polyepichlorohydrin, and so forth), polyfluorocarbons, formaldehyde polymers (such as, for example, urea-formaldehyde, melamine-formaldehyde, phenol formaldehyde, etc.), polyolefins (such as, for example, polyethylene, polypropylene, polybutylene, polybutene, polyoctene, etc.), polyphenylenes (such as, for example, polyphenylene oxide, polyphenylene sulfide, polyphenylene ether sulfone, etc.), silicon containing polymers (such as, for example, polydimethyl siloxane, polycarbomethyl silane, etc.), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone, etc.), polyacetals, polyarylates, and copolymers (such as, for example, polyethylene-co-vinyl acetate, polyethylene-co-acrylic acid, polybutylene terephthalate-co-polyethylene terephthalate, polylauryllactam-block-polytetrahydrofuran, vinyl chloride, regenerated cellulose such as viscose rayon, glass fibers, ceramic fibers, bicomponent fibers, melamine fibers (e.g., fibers obtained from melamine-formaldehyde resin), etc.

For the purposes of the present invention, the term "bicomponent fibers" refers to fibers comprising a core and sheath configuration. The core and sheath portions of bicomponent fibers may be made from various polymers. For example, bicomponent fibers may comprise a PE (polyethylene) or modified PE sheath which may have a PET (polyethylene terephthalate) or PP (polypropylene) core. In one embodiment, the bicomponent fiber may have a core made of polyester and sheath made of polyethylene. Alternatively, a multicomponent fiber with a PP (polypropylene) or modified PP or PE sheath or a combination of PP and modified PE as the sheath or a copolyester sheath wherein the copolyester is isophthalic acid modified PET (polyethylene terephthalate) with a PET or PP core, or a PP sheath-PET core and PE sheath-PP core and co-PET sheath fibers may be employed. Various geometric configurations may be used for the bicomponent fiber, including concentric, eccentric, islands-in-thesea, side-by-side, etc. The relative weight percentages and/or proportions of the core and sheath portions of the bicomponent fiber may also be varied.

For the purposes of the present invention, the term "trivalent metal" refers to a metal which may have a positive charge of three (e.g., boron, zinc, an iron (ferric), cobalt, nickel, aluminum, manganese, chromium, etc.), and may include combinations of one or more of these trivalent metals. Sources of trivalent metals may include one or more of organic or inorganic salts, for example, from one or more of the following anions: acetate, lactate, EDTA, halide, chloride, bromide, nitrate, chlorate, perchlorate, sulfate, acetate, carboxylate, hydroxide, nitrite, etc. The salt may be a simple salt, wherein the trivalent metal forms a salt with one or more of the same anion, or a complex salt, wherein the trivalent metal forms a salt with two or more different anions. In one embodiment, the salt may be aluminum chloride, aluminum carbonate, aluminum sulfate, alum (e.g., aluminum ammonium sulfate, aluminum potassium sulfate, aluminum sulfate, etc.), etc.

For the purposes of the present invention, the term "debonder surfactant" refers to surfactants which are useful in the treatment of pulp fibers to reduce inter-fiber bonding. Suitable debonder surfactants may include one or more of: cationic surfactants or nonionic surfactants, such as linear or branched monoalkyl amines, linear or branched dialkyl amines, linear or branched tertiary alkyl amines, linear or branched quaternary alkyl amines, linear or branched, saturated or unsaturated hydrocarbon surfactants, fatty acid amides, fatty acid amide quaternary ammonium salts, dialkyl dimethyl quaternary ammonium salts, dialkylimidazolinium quaternary ammonium salts, dialkyl ester quaternary ammonium salts, triethanolamine-ditallow fatty acids, fatty acid ester of ethoxylated primary amines, ethoxylated quaternary ammonium salts, dialkyl amide of fatty acids, dialkyl amide of fatty acids, ethoxylated alcohols, such as $C_{16}$-$C_{18}$ unsaturated alkyl alcohol ethoxylates, commercially available compound having CAS Registry No. 68155-01-1, commercially available compound having CAS Registry No. 26316-40-5, commercially available Eka Chemical F60™ (an ethoxylated alcohol surfactant), commercially available Cartaflex TS LIQ™, commercially available F639™, commercially available Hercules PS9456 ™, commercially available Cellulose Solutions 840™, commercially available Cellulose Solutions 1009™, commercially available EKA 509H™, commercially available EKA 639™, etc. See also U.S. Pat. No. 4,425,186 (May et al.), issued Jan. 10, 1984, the entire contents and disclosure of which is hereby incorporated by reference, which discloses a combination of a cationic surfactant and a dimethylamide of a straight chain carbon carboxylic acid containing 12 to 18 carbon atoms which may be useful as a debonder surfactant.

For the purposes of the present invention, the term "fire resistant article" refers to an article (e.g., pulp fiber web, air-laid fibrous structure, etc.) which has been treated with a fire retardant in an amount sufficient to make the treated material resistant to fire, flame, burning, etc., as determined by certain fire resistance test(s), such as the UL 94 test, the Horizontal Burn Through method test, the ASTM D 5132-04 test, etc.

For the purposes of the present invention, the term "fire resistance test" refers to a test which measures the fire resistant characteristics, properties, etc., of an article, a material, etc. These tests may include the UL 94 test, the Horizontal Burn Through method test, the ASTM D 5132-04 test, etc.

For the purposes of the present invention, the term "UL 94 HBF test" (also known as the "Horizontal Burning Foamed Material Test") refers to a fire resistance test (authored by Underwriters Laboratories) which is used to measure the flammability of articles, such as foamed plastic materials, used in parts in devices or appliances, etc. The UL HBF 94 test measures the ability of such articles to prevent flame propagation. The UL HBF 94 test may be conducted on specimens which are 150 (±5) mm long×50 (±1) mm wide and having a minimum/maximum covering the thickness range of materials to be tested. See pages 27-33 and FIG. 12-1 on page 32, UL 94 "Tests for Flammability of Plastic Materials for Parts in Devices and Appliances" published by Underwriters Laboratories Inc., Standard for Safety (2009), the entire contents and disclosure of which is herein incorporated by reference, for how to carry out the UL 94 HBF test method, including apparatus used and specimen preparation.

For the purposes of the present invention, the term "Horizontal Burn Through test" (also known as the "California test") refers to fire resistance test which measures the ability of the article being tested to resist burning by forming, for example, a stable char that insulates the remaining uncharred material of the article from heat. Articles, materials, etc., are considered to have passed the Horizontal Burn Through test is there is no burn through after the specimen being tested is exposed to a flame for at least 15 minutes. The Horizontal Burn Through test may be conducted on specimens which are 10 cm×10 cm square and which are then centrally positioned on a 6.35 mm (0.25 inch) thick square steel plate approximately 15 cm.times.15 cm (6.times.6 inches). The plate has a circular hole of a diameter of 50.8 mm (or 2 inches) machined concentrically through the center portion. The specimen is mounted level over a Bunsen burner which is fed with a natural gas flow rate of 415 ml/min. so that when moved under the specimen, the tip of the flame just touches the underside of the barrier in the center of the hole, the flame being held in contact with the specimen for a total of 15 minutes after which the condition of the specimen is assessed for burn through. See paragraphs [0158]-[0160] of U.S. Pat. Appln. No. 20080050565 (Gross et al.), published Feb. 28, 2008, the entire disclosure and contents of which is herein incorporated by reference, which describes how to carry out the Horizontal Burn Through test. Specimen preparation for specimens used in carrying out the Horizontal Burn Through test method according to the present invention are described in the section below entitled "Fire Resistant Test Specimen Preparation."

For the purposes of the present invention, the term "ASTM D 5132-04 test" (also known as the "Horizontal Burning Rate of Polymeric Materials Used in Occupant Compartments of Motor Vehicles" test) refers to fire resistance test used to compare relative horizontal burning rates of polymeric materials used in occupant compartments of motor vehicles. This test method employs a test specimen having test dimensions of 100 (±5) mm wide by 300 mm in length with a thickness of up to 13 mm which is mounted on a U-shaped metal frame. The test specimen is ignited by using a 38-mm flame from an appropriate burner, with burning rate of the material then being determined. The rate of burning is calculated by measuring the distance, D, (in mm.) the flame travels on the test specimen, divided by the time, T, (in seconds) required to travel the distance, D, multiplied by 60.

For the purposes of the present invention, the term "fire retardant" refers to one or more substances (e.g., composition, compound, etc.) which are able to reduce, impart resistance to, etc., the flammability, the ability to burn, etc., of a material, article, etc. Fire retardants may include one or more endothermic fire retardants, and optionally one or more other (nonendothermic) fire retardants.

For the purposes of the present invention, the term "endothermic fire retardant" refers to fire retardants which absorb heat when exposed to a source of flame. Endothermic fire retardants may include one or more of: boron-containing fire retardants such as borate fire retardants (e.g., boric acid, borax, sodium tetraborate decahydrate, zinc borate, etc.), borosilicate (i.e., condensates of boron oxides and silica with other metal oxides, for example sodium oxide and aluminum oxide) fire retardants (e.g., may include borosilicates used in making glass, etc.), other substances which retain water or water vapor at room temperature such as alum (aluminum ammonium sulfate), talc (magnesium silicate), aluminum hydroxide (as known as alumina trihydrate), magnesium hydroxide (also known as magnesium dihydroxide), mixtures (e.g., equal mixtures) of huntite (calcium magnesium carbonate or $CaMg_3(CO_3)_4$) and hydromagnesite (hydrated magnesium carbonate hydroxide or $Mg_{54}(CO_3)_4(OH)_2.4H_2O$), etc. See Weil et al., Flame Retardants for Plastics and Textiles (Hanser Publishers, Munich, 2009), pp. 4-8, the entire contents and disclosures of which are herein incorporated by reference.

For the purposes of the present invention, the term "other fire retardant" refers to fire retardants which are not endothermic fire retardants. Other fire retardants may include one or more of phosphorous fire retardants, halogenated hydrocarbon fire retardants, metal oxide fire retardants, etc. For example, these other fire retardants may comprise a mixture, blend, etc., of one or more phosphorous fire retardants, one or more halogenated hydrocarbon fire retardants, and one or more metal oxide fire retardants.

For the purposes of the present invention, the term "phosphorous fire retardant" refers to a fire retardant substance, compound, molecule, etc., which comprises one or more phosphorous atoms. Phosphorous fire retardants may include one or more of: phosphates, such as sodium phosphates, ammonium phosphates, sodium polyphosphates, ammonium polyphosphates, melamine phosphates, ethylenediamine phosphates etc.; red phosphorus; metal hypophosphites, such as aluminum hypophosphite and calcium hypophosphite; phosphate esters; etc. For embodiments of the present invention, the phosphorus fire retardant disperses on and/or in the cellulosic fibers and may, in some embodiments (e.g., ammonium phosphates) form a bond (i.e., crosslink) to cellulose which forms a stable char during exposure to the flame. Some proprietary phosphorous fire retardants may include, for example: Spartan™ AR 295 Flame Retardant from Spartan Flame Retardants Inc. of Crystal Lake, Ill., include both organic and inorganic constituents, GLO-TARD FFR2, which is an ammonium polyphosphate fire retardant from GLO-TEX International, Inc. of Spartanburg, S.C.; Fire Retard 3496, which is a phosphate ester supplied by Manufacturers Chemicals, L.P. of Cleveland, Tenn, Flovan CGN, a multi-purpose phosphate-based flame retardant supplied by Huntsman (Salt Lake City, Utah); SPARTAN™ AR 295, a diammonium phosphate based flame retardant from Spartan Flame Retardants, Inc. (Crystal Lake, Ill.), FRP 12™, FR 165™, and FR8500™ supplied by Cellulose Solutions, LLC (Daphne, Ala.), etc.

For the purposes of the present invention, the term "halogenated organic fire retardant" refers to a halogenated organic compound which alone, or in combination with other substances, compounds, molecules, etc., are capable of functioning as a fire retardant. Halogenated organic fire retardants may include one or more of: halogenated (e.g., chlorinated, brominated, etc.) hydrocarbons, such as halogenated aliphatics (e.g., haloalkanes), halogenated aromatics, etc. Halogenated organic fire retardants may include chloroparaffins, Dechorane Plus (a chlorine-containing halogenated fire retardant), decabromodiphenyl oxide, tetradecabromodiphenoxybenzene, ethylenebispentabromobenzene (EBPB); tetrabromobisphenol A (TBBA), tetrabromobisphenol A bis-hexabromocyclododecane, ethylenebis-(tetrabromophthalimide). These halogenated organic fire retardants may work by eliminating oxygen from the burn zone which quenches, extinguishes, smothers, puts out, etc., the flame.

For the purposes of the present invention, the term "metal oxide fire retardant" refers to metal oxides which alone, or in combination with other substances, are capable of functioning as a fire retardant. Metal oxide fire retardants may include one or more of: aluminum oxide (alumina), antimony trioxide, ferric oxide, titanium dioxide, stannic oxide, etc.

For the purposes of the present invention, the term "fire retardant distributing surfactant" refers to surfactants which function to distribute, disperse, etc., the fire retardant over, through, etc., the fibrous matrix of the pulp fiber web. Suitable fire retardant distributing surfactants may be ionic or non-ionic, have a rheology which permits the surfactant to be dispersed on and/or through the pulp fiber web being treated with the fire retardant component, carries the fire retardant component on and/or through the pulp fiber web (i.e., the fire retardant component is not fully dissolved in the surfactant), enables or at least does not inhibit crosslinking between fire retardants (e.g., crosslinkable phosphorous fire retardants such as the ammonium phosphates) in the fire retardant component and the cellulosic fibers in the pulp fiber web, etc. Suitable fire retardant distributing surfactants may include one or more of: alkoxylated alcohols/alcohol alkoxylates (e.g., BASF's Plurafac® alcohol alkoxylates) which may include ethoxylated alcohols (e.g., Eka Chemical's F60 surfactant, etc. Suitable ethoxylated alcohols for use as fire retardant distributing surfactants may comprise from about 1 to about 30 ethylene oxide (EO) units, for example, from about 4 to about 25 EO units, with an alcohol carbon chain length of from about 6 to about 30 carbon atoms, for example, from about 6 to about 22 carbon atoms, such as from about 12 to about 18 carbon atoms (e.g., from about 16 to 18 carbon atoms). See U.S. Pat. No. 7,604,715 (Liesen et al.), issued Oct. 20, 2009, the entire contents and disclosure of which is incorporated by reference.

For the purposes of the present invention, the term "near neutral pH" refers to a pH in the range of from about 5 to about 9, for example, from about 6 to about 8, such as about 7.

For the purposes of the present invention, the term "pH adjusting agent" refers a composition, compound, etc., which may be included to raise or lower the pH of the endothermic fire retardant solution, the pulp slurry to which the endothermic fire retardant solution, as well as other fire retardants, fire retardant distributing surfactants, etc., are added, etc., to provide a treated pulp fiber web having a near neutral pH. Suitable pH adjusting agents may include acids or bases, buffering agents which may be may be weak acids or weak bases (i.e., proton acceptors) and may include one or more of: trivalent metal ammonium sulfates, such as aluminum ammonium sulfate (e.g., alum), ferric ammonium sulfate, chromium ammonium sulfate, cobalt ammonium sulfate, manganese ammonium sulfate, nickel ammonium sulfate, etc., other ammonium salts which function as weak bases such as ammonium sulfate, etc. In some embodiments, endothermic fire retardants by themselves may also function as the pH adjusting (e.g., buffering) agent.

For the purposes of the present invention, the term "at a point prior to when the pulp fiber web is formed" refers any point any point prior to when the pulp fiber web is formed (e.g., prior to forming the pulp fiber web on a forming wire) and may include the forming the pulp slurry in the blend chest, after the pulp slurry is formed by the blend chest and prior to transfer to the head box, after transfer of the pulp slurry to the head box but prior to depositing a furnish from the headbox, e.g., prior to depositing on the a forming wire, etc.

For the purposes of the present invention, the term "at a point after the pulp fiber web is formed and prior to drying of the fibrous web" refers any point any point after the pulp fiber web is formed and prior to the point when the pulp fiber web is dried, and may include forming pulp fiber web on a forming wire, passing the pulp fiber web through a size press, passing the pulp fiber web past or through a sprayer or other applicating device (e.g., coater), etc.

For the purposes of the present invention, the term "at a point after drying of the fibrous web" refers any point any point after the pulp fiber web is dried and up to and including when an air-laid fibrous structure is constructed from the dried pulp fiber web.

For the purposes of the present invention, the term "solids basis" refers to the weight percentage of each of the respective solid materials (e.g., fire retardants, surfactants, dispersants, etc.) present in the pulp fibers, web, composition, etc., in the absence of any liquids (e.g., water). Unless otherwise specified, all percentages given herein for the solid materials, compounds, substances, etc., are on a solids basis.

For the purposes of the present invention, the term "solids content" refers to the percentage of non-volatile, non-liquid components (by weight) that are present in the pulp fibers, web, composition, etc.

For the purposes of the present invention, the term "gsm" is used in the conventional sense of referring to grams per square meter.

For the purposes of the present invention, the term "mil(s)" is used in the conventional sense of referring to thousandths of an inch.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "room temperature" refers to the commonly accepted meaning of room temperature, i.e., an ambient temperature of 20° to 25° C.

For the purposes of the present invention, the term "optical brightness" refers to the diffuse reflectivity of the pulp fiber web/pulp fibers, for example, at a mean wavelength of light of 457 nm. As used herein, optical brightness of pulp fiber webs may be measured in terms of ISO Brightness which measures brightness using, for example, an ELREPHO Datacolor 450 spectrophotometer, according to test method ISO 2470-1, using a C illuminant with UV included.

For the purposes of the present invention, the term "optical brightener agent (OBA)" refers to certain fluorescent materials which may increase the brightness (e.g., white appearance) of pulp fiber web surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the pulp fiber webs. With the use of OBAs, this short-wavelength light that causes the yellow tint or cast is partially replaced, thus improving the brightness and whiteness of the pulp fiber web. OBAs are desirably optically colorless when present on the pulp fiber web surface, and do not absorb light in the visible part of the spectrum. These OBAs may be anionic, cationic, anionic (neutral), etc., and may include one or more of: stilbenes, such as 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®.

For the purpose of the present invention, the term "treating" with reference to the fire retardant compositions may include adding, depositing, applying, spraying, coating, daubing, spreading, wiping, dabbing, dipping, etc., to the pulp fibers, pulp fiber web, air-laid fibrous structure, etc.

For the purposes of the present invention, the term "applicator" refers to a device, equipment, machine, etc., which may be used to treat, apply, coat, etc., one or more sides or surfaces of a pulp fiber web, air-laid fibrous structure, etc., with the fire retardant composition. Applicators may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., the fire retardant composition on a pulp fiber web, air-laid fibrous structure, etc. Metering size presses may include a rod metering size press, a gated roll metering size press, a doctor blade metering size press, etc.

For the purposes of the present invention, the term "rod metering size press" refers to metering size press that uses a rod to spread, meter, etc., the fire retardant composition on a pulp fiber web, air-laid fibrous structure, etc. The rod may be stationary or movable relative to the web.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the web, may rotate relative to the web, etc.

For the purposes of the present invention, the term "doctor blade metering size press" refers to a metering press which may use a doctor blade to spread, meter, etc., the fire retardant composition on a pulp fiber web, air-laid fibrous structure, etc.

Description

Embodiments of the process of the present invention comprise providing an at least partially delignified pulp fiber web having a Kappa number of less than about 130 (e.g., less than about 50). The pulp fiber web may comprise at least about 50% (for example, from about 50 to about 70%, such as from about 70 to about 80%) softwood pulp fibers and up to about 50% (for example, from about 30 to about 50%, such as from about 20 to about 30%) hardwood pulp fibers. Embodiments of the process of the present invention also comprise treating the pulp fiber web with an aqueous endothermic fire retardant solution having a pH of about 10 or less (e.g., a pH of from about 5 to about 9, such as from about 6 to about 8) and comprising at least about 10% (e.g., from about 10 to about 70% based on the total solids in the solution) of one or more endothermic fire retardants. The pulp fiber web is treated with a total amount of endothermic fire retardants of at least about 20 lbs (e.g., from about 20 to about 250 lbs) of endothermic fire retardants per ton of the pulp fiber web, wherein at least about 5% (e.g., an initial portion of from about 5 to about 33%) of the total amount of endothermic fire retardants are added at a point prior to when the pulp fiber web is formed. In some embodiments, the remaining portion of from about 67 to about 95% of the total amount of endothermic fire retardants are added at a point after the pulp fiber web is formed, for example, at a point after the pulp fiber web is dried.

In some embodiments of the process of the present invention, the pulp fiber web may also be treated with one or more other fire retardants in an amount up to about 90% (e.g., from about 10 to about 90%) of the total fire retardants used to treat the pulp fiber web); and optionally one or more fire retardant distributing surfactants in an amount sufficient to distribute the other fire retardants in and/or on the pulp fiber web. Treatment with the endothermic fire retardant solution (and optionally any other fire retardants and a fire retardant distributing surfactants) provides a treated pulp fiber web having a near neutral pH (e.g., a pH of from about 5 to about 9, such as from about 6 to about 8). Providing a fire retardant treated pulp fiber web having a near neutral pH enables the resultant web, for example, to be to provide an air-laid fibrous structure, avoids/minimizes corrosion of metal components the retardant treated pulp fiber web comes into contact with, avoids/minimizes skin irritation, etc.

In some embodiments of the process of the present invention, the other optional fire retardants and optional fire retardant distributing surfactants are added to the pulp fiber web at a point after the pulp fiber web is formed and prior to drying of the fibrous web. In some embodiments of the process of the present invention, any remaining endothermic fire retardant is added (e.g., sprayed, dosed, etc.) on the pulp fiber web at a point after drying of the fibrous web. In some embodiments of the process of the present invention, one type of endothermic fire retardant (e.g., aluminum ammonium sulfate or alum) is added at a point prior to when the pulp fiber web is formed, while a different type of endothermic fire retardant (e.g., ammonium phosphate or borosilicate) is added (e.g., sprayed, dosed, etc.) on the pulp fiber web at a point after drying of the fibrous web.

Embodiments of the fire resistant pulp fiber webs of the present invention having a near neutral pH comprise: an at least partially delignified pulp fiber web having a Kappa number as previously described; a fire retardant component present in and/or on the pulp fiber web in an amount of at least about 20 lbs (e.g., from about 20 to about 250 lbs) of fire retardant component per ton of the pulp fiber web; and one or more fire retardant distributing surfactants in an amount sufficient (e.g., from about 1 to about 10 lbs per ton of the pulp fiber web) to distribute the fire retardant component in and/or on the pulp fiber web. The fire retardant component comprises at least about 10% (e.g., from about 10 to about 90%, such as from about 40 to about 60%) by weight of the fire retardant component of one or more endothermic fire retardants; and up to about 90% (e.g., from about 10 to about 90%, such as from about 40 to about 60%) by weight of the fire retardant component of one or more other fire retardants. The fire retardant component is also present in an amount and is distributed in and/or on the pulp fiber web in a manner so that the fire resistant pulp fiber web passes one or more of the following tests: the UL 94 HBF test, the Horizontal Burn Through test, or the ASTM D 5132-04 test.

Embodiments of the fire resistant pulp fiber webs of the present invention may also be used in air-laid fibrous structures which may comprise: an air-laid fibrous core having an upper surface and a lower surface; a first fire resistant outer layer positioned over the upper surface; and a second fire resistant outer layer positioned under the lower surface. The air-laid fibrous core may comprise: from about 50 to about 97% (e.g., from about 80 to about 95%) by weight of the core of comminuted pulp fibers; and from about 3 to about 50% (e.g., from about 5 to about 20%) by weight of the core of bicomponent fibers. Each of the upper and lower outer layers may comprise: from about 50 to about 95% (e.g., from about 80 to about 95%) by weight of the core of comminuted fire resistant pulp fiber fibers according to embodiments of the present invention; and from about 5 to about 50% (e.g., from about 5 to about 20%) by weight of the core of bicomponent fibers, and may comprise the same proportions by weight of fire resistant pulp fiber fibers and bicomponent fibers, or may comprise different proportions by weight of fire resistant pulp fiber fibers and bicomponent fibers. These outer layers may also optionally comprise up to about 20% (for example, up to about 10%, such as up to about 3%) by weight of the outer layer of melamine fibers or melamine resin powder to increase the fire resistant properties of these outer layers. These outer layers may also be treated with additional fire retardant in amounts of up to about 5% (for example, up to about 3%, such as up to about 2%) by weight of the outer layer to further increase the fire resistance of the outer layer. This additional fire retardant may be the same or a may be different from the fire retardant used to treat the pulp fiber web to provide the fire resistant pulp fiber web. Embodiments of these fire retardant air-laid fibrous structures (e.g., cores and associated outer layers) may be used, for example, in upholstery cushions, mattress ticking, panel fabric, padding, bedding, insulation, materials for parts in devices and appliances, etc.

The pulp fiber web may be prepared from the pulp fiber by any suitable process for providing pulp fiber webs. For example, the pulp fiber web may be formed from a pulp fiber mixture into a single or multi-ply web on a papermaking machine such as a Fourdrinier machine or any other suitable papermaking machine known in the art for making pulp fiber webs. See, for example, U.S. Pat. No. 4,065,347 (Aberg et al.), issued Dec. 27, 1997; U.S. Pat. No. 4,081,316 (Aberg et al.), issued Mar. 28, 1978; U.S. Pat. No. 5,262,005 (Ericksson et al.), issued Nov. 16, 1993, the entire contents and disclosure of which are herein incorporated by reference. The pulp fiber mixture may also be treated with one or more debonder surfactants (as described above) to make the process of comminuting such pulp fiber webs (e.g., for providing air-laid fibrous structures) easier to carry out. The resulting pulp fiber web which is formed may be dried to remove a portion, most or all of the water from the web, with the dried web being optionally treated with one or more additional debonder surfactants to again enhance the process of comminuting such pulp fiber webs.

In some embodiments, the pulp fiber web may be dried in a drying section prior to and/or after treatment with an aqueous solution of the endothermic fire retardant and/or other fire retardants. Any suitable method for drying pulp fiber webs known in the making art may be used. The drying section may include a drying can, flotation dryer, cylinder drying, Condebelt drying, infrared (IR) drying, etc. The treated and/or untreated pulp fiber web may be dried to a moisture content of about 10% or less, such as about 7% or less. For example, the pulp fiber web may be dried to a moisture content of between 0 and about 10% (which includes any value and subrange, for example, values or subranges including 3, 4, 5, 6, 7, 8, 9, 10, etc.).

In some embodiments (e.g., air-laid fibrous structures), the pulp fiber web may have a basis weight in the range of from about 500 to about 850 gsm (which includes any value and subrange, for example, values or subranges including about 500, 550 600, 650, 700, 750, 800, 850 gsm, etc.). In some embodiments, the pulp fiber web may have a density of about 0.3 g/cc or less, and in the range of from about 0.1 to about 0.3 g/cc (which includes any value and subrange, for example, values or subranges including about 0.1, 0.15, 0.2, 0.25, and 0.3 g/cc, etc.). In some embodiments, the pulp fiber web may have a caliper of at least about 30 mils, for example in the range of from about 30 to about 85 mils, such as from about 45 to about 65 mils (which includes any value and subrange, for example, values or subranges including about 30, 35, 40, 45, 50, 55, 65, 70, 75, 80, 85 mils, etc.). In some embodiments, the pulp fiber may have a fiberization (shred) energy of less than about 170 kJ/kg (which includes any value and subrange, for example, values or subranges including about 1, 2, 3, 4, 5, 6, 7, 8, 9, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165 kJ/kg, etc.). In other embodiments, the pulp fiber web may have a fiberization energy in the range of from about 120 to less than about 145 kJ/kg, in the range of from about 100 to less than about 120 kJ/kg. In one embodiment, the pulp fiber web may have a fiberization energy of less than about 135 kJ/kg for example, a fiberization energy of less than about 120 kJ/kg, such as less than about 100 kJ/kg, or less than about 90 kJ/kg. In other embodiments, the pulp fiber web may have a fiberization energy in the range of from about 120 to less than about 145 kJ/kg, in the range of from about 100 to less than about 120 kJ/kg.

In some embodiments, the pulp fiber web may comprise debonder surfactant in an amount of about 1 lb solids or greater per ton of the pulp fibers (which includes any value and subrange, for example, values or subranges including about 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20 lbs solids debonder surfactant per ton of the pulp fibers, etc., or higher). In some embodiments, the pulp fiber web may comprise a trivalent metal (or salt thereof) in an amount of about 1 lb solids or greater per ton of the pulp fiber fibers (which includes any value and subrange, for example, values or subranges including about 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20, 25, 30, 35 lbs cationic trivalent metal/salt thereof, etc., or higher). In some embodiments, the pulp fiber web may comprise the trivalent metal in an amount of about 150 ppm or greater per ton of the pulp fibers (which includes any value and subrange, for example, values or subranges including about 150, 155, 160, 165, 170, 175, 180, 185, 190, 195, 200, 205, 210, 215, 220, 225, 230, 235, 240, 245, 250, 300, 330, 400, 450, 500, 550, 750, 1000 ppm, etc., or higher).

Embodiments of the fire resistant pulp fiber web of the present invention may be used, for example, to provide air-laid fibrous structures, including air-laid fibrous cores, air-laid fibrous layers (including outer layers for air-laid fibrous cores), etc. See, for example, U.S. Pat. Appln. No. 20080050565 (Gross et al.), published Feb. 28, 2008; U.S. Pat. No. 6,059,924 (Hoskins), issued May 9, 2000); U.S. Pat. No. 7,549,853 (Fegelman et al.), issued Jun. 23, 2009, the entire disclosure and contents of which are herein incorporated by reference. The fire resistant pulp fiber webs may be comminuted (e.g., defiberized, disintegrated, shredded, fragmented, etc.) to provide such air-laid fibrous structures using known methods for making such structures. See, for example, U.S. Pat. No. 3,591,450 (Murphy et al.), issued Jul. 6, 1971, the entire contents and disclosure of which is herein incorporated by reference. For example, the fire resistant pulp fiber webs may be defiberized, disintegrated, shredded, fragmented, etc., by using a hammermill. In one embodiment, hammer milling is carried out in a manner which does not induce significant dust creation in the comminuted fire resistant pulp fibers. The resultant air-laid fibrous structure may be used in a variety of products, for example, upholstery cushions, mattress ticking, panel fabric, padding, bedding, insulation, materials for parts in devices and appliances, etc.

In some embodiments, the air-laid fibrous structures may comprise a mixture, blend, etc., of comminuted fire resistant pulp fibers and synthetic fibers (e.g., bicomponent fibers). For example, the air-laid fibrous structure may be in the form of an air-laid fibrous core which comprises a mixture, blend, etc., of comminuted fire resistant pulp fibers and synthetic fibers (e.g., bicomponent fibers). For example, these structures may comprise about 50% or greater (for example, about 75% or greater) by weight fire resistant pulp fiber, about 50% or less (for example, about 15% or less) synthetic fiber (e.g., bicomponent fiber), and optionally up to about 20% (e.g., from about 3 to about 10%) melamine fiber/powder. (Air-laid fibrous structures without melamine fiber may pass the UL 94 TMVB test when those structures comprise, for example, about 90% fire resistant pulp fiber and about 10% bicomponent fiber, and are sprayed with about 3% fire retardant on the surface of the outer layers of such structures.)

Embodiments of the air-laid fibrous structures may be prepared by comminuting (e.g., disintegrating, defibrizing, etc.) a pulp fiber web (e.g., a pulp fiber sheet), for example, by using a hammermill (such as a Kamas Hammermill), to provide individualized comminuted pulp fibers. The comminuted pulp fibers may then be air conveyed to forming heads on an air-laid web-forming machine. A number of manufacturers provide air-laid web forming machines suitable for use in embodiments of the air-laid fibrous structures of the present invention, including Dan-Web Forming of Aarhus, Denmark, M&J Fibretech A/S of Horsens, Denmark, Rando Machine Corporation of Macedon, N.Y. (for example, as described in U.S. Pat. No. 3,972,092 to Wood, issued Aug. 3, 1976, the entire contents and disclosure of which is herein incorporated by reference), Margasa Textile Machinery of Cerdanyola del Valles, Spain, and DOA International of Wels, Austria. While these various forming machines may differ in how the comminuted pulp fiber is opened and air-conveyed to the forming wire, all of these machines are capable of producing webs useful for forming embodiments of air-laid fibrous structures.

The Dan-Web forming heads may include rotating or agitated perforated drums, which serve to maintain fiber separation until the fibers are pulled by vacuum onto a foraminous forming conveyor, forming wire, etc. In the M&J machine, the forming head may basically be a rotary agitator above a screen. The rotary agitator may comprise a series or cluster of rotating propellers or fan blades. Synthetic fibers (e.g., bicomponent fibers) may also be opened, weighed, and mixed in a fiber dosing system such as a textile feeder supplied by Laroche S.A. of Cours-La Ville, France. From the textile feeder, the synthetic fibers may be air conveyed to the forming heads of the air-laid machine where those synthetic fibers are further mixed with the comminuted pulp fibers from the hammermill(s) and may be deposited on a continuously moving forming wire. For providing defined air-laid fibrous layers, separate forming heads may be used for each type of fiber.

The air-laid fibrous web may be transferred from the forming wire to a calender or other densification stage to densify the air-laid fibrous web, if necessary, to increase its strength and to control web thickness. The fibers of the air-laid fibrous web may then be bonded by passage through an oven set to a temperature high enough to fuse any included thermoplastic synthetic fibers or other binder materials. Secondary binding from the drying or curing of a latex spray or foam application may also occur in the same oven. The oven may be a conventional through-air oven or may be operated as a convection oven, but may also achieve the necessary heating by infrared or even microwave irradiation.

Embodiments the process of the present invention for providing fire resistant pulp fiber webs are further illustrated in FIG. 1. FIG. 1 is a schematic diagram which shows an illustrative process for providing a fire resistant pulp fiber web according to an embodiment of the present invention, which is indicated generally as 100. In process 100, the at least partially delignified pulp fibers (indicated as Delignified Pulp Fibers 102) are used, as indicated by arrow 104, in formulating Pulp Slurry 106. As Pulp Slurry 106 is being transferred, pumped, etc., as indicated by arrow 108, to Forming Wire 110, an aqueous endothermic fire retardant solution comprising an initial portion of endothermic fire retardant such as aluminum ammonium sulphate or alum (indicated as Initial Endothermic FR 112, which may also provide a source trivalent metal ions), is added to Pulp Slurry 106, as indicated by arrow 114. After Initial Endothermic FR 112 is added, Pulp Slurry 106 is then deposited (e.g., using a headbox), as indicated by arrow 108, onto Forming Wire 110 to form the fire retardant-treated pulp fiber web. As indicated by arrow 116, the pulp fiber web is eventually transferred from Forming Wire 110 to Dryer 118. As the pulp fiber web is being transferred from Forming Wire 110 to Dryer 118, other fire retardants such as a phosphorous fire retardant (indicated as Other FRs 120), along with a fire retardant distributing surfactant (indicated as Surfactant 122), are added, as indicated, respectively, by arrows 124 and 126. In some embodiments, Other FRs 120 and Surfactant 122 may be mixed together before being added to the pulp fiber web, or may added separately to the pulp fiber web.

Upon leaving Dryer 118, as indicated by arrow 128, the treated and dried pulp fiber web becomes Dried Web 130. As indicated by arrow 132, Dried Web 130 may be used to form Air-Laid Structure 134. As indicated by arrow 136, Air-Laid Structure 134 may be treated (e.g., sprayed with, dosed with, etc.) any of the remaining endothermic fire retardant, such as a borate fire retardant (indicated as Remaining Endothermic FR 138) along with any additional and optional fire retardant distributing surfactant (indicated as Surfactant 140), as indicated by arrow 142. Alternatively, and as indicated by dashed arrow 144, in some embodiments, Dried Web 130 may be directly treated with (e.g., sprayed with, dosed with, etc.) Remaining Endothermic FR 138 (when, for example, not being formed into Air-Laid Structure 134 or prior to being formed into Air-Laid Structure 134). Also alternatively in some embodiments, and as indicated by dashed arrow 146, some or all of the other fire retardants, plus fire retardant distributing surfactant (indicated as Endothermic FR+Surfactant 148) may also be added (e.g., sprayed with, dosed with, etc.) to Dried Web 130.

Figure 2:
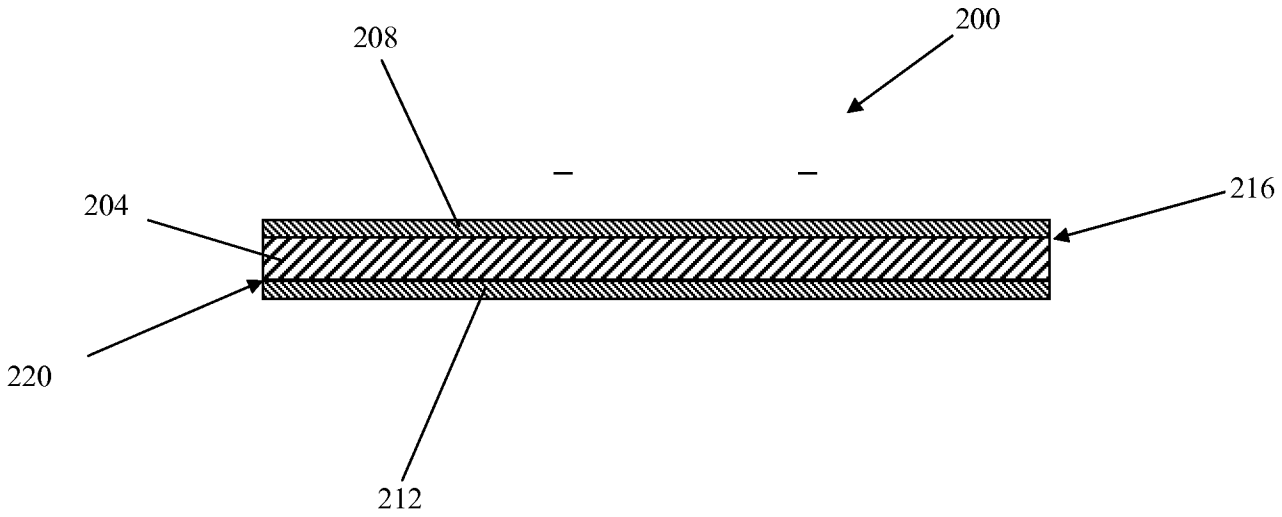
FIG. 2 is side sectional view of an air-laid fibrous structure which comprises a fire resistant pulp fiber web according to an embodiment of the present invention as the respective outer layers of the air-laid fibrous core of the structure.

FIG. 2 is side sectional view of an air-laid fibrous structure which comprises a fire resistant pulp fiber web according to an embodiment of the present invention as the respective outer layers of the air-laid fibrous core of the structure, which is indicated generally as 200. Structure 200 comprises an air-laid fibrous core, indicated generally as 204, and two outer fire retardant outer air-laid fibrous layers, indicated respectively as upper layer 208 and lower layer 212. Upper outer layer 208 is positioned on or adjacent upper surface 216 of core 204, while lower outer layer 212 is positioned on or adjacent lower surface 220 of core 204. Outer layers 208 and/or 212 of structure 200 may be treated with additional fire retardant (for example, the additional fire retardant may be diluted with water and/or other solvent(s), with the water/solvent(s) being removed, for example, by heating after treatment).

Fire Resistant Test Specimen Preparation

The specimens for the fire resistance tests are prepared as follows: Fire retardant-treated pulp fiber web sheets are defiberized in a lab hammermill (Kamas Type H 01 Laboratory Defribrator) by shredding 2 inch width strips at 3300 rpm using a 10 mm screen opening and 7 cm/sec. feed speed. The defiberized pulp fibers are mixed in the plastic bag by hand and by vigorously shaking the sealed bag which contains air space, to achieve as uniform a distribution of fiber fractions as possible, i.e., to achieve a representative test specimen. Approximately 3.4 g of the mixed pulp fibers are weighed out to provide a target weight of 3.16 g±0.1 g (300 g/m$^2$). A piece of the nonwoven barrier material is inserted into a collection basket/cup of an 11 cm diameter forming funnel which is attached in the hammermill. The weighed pulp fibers are refiberized in the hammermill using the front chute with a rotor setting at ~750 rpm and with a 14 mm screen in place. With the forming funnel removed from the hammermill, the refiberized pulp in the funnel is evenly spaced using long handle tweezers, and then pressed firmly into the funnel with a tamping tool. The resultant specimen is then removed and weighed. The weighed specimen is then placed without the nonwoven barrier material between two blotters and feed through a press. The thickness of the resultant specimen is then measured with the target density of the specimen being 0.1 g/cm$^3$ which equals a thickness of 1.32 mm or 0.052" (i.e., 52 mils). The fiberization energy of the specimen may be calculated as described above based on energy measured and displayed by the Kamas Type H 01 Laboratory Defribrator (converted, if necessary from watt hours or wH), divided by the fiberized fiber weight, to provide a value in kJ/kg.

EXAMPLES

Pulp fiber webs treated with endothermic fire retardants are prepared as described below:

Example 1

A fluff pulp (which contains 20 lbs per ton of aluminum ammonium sulfate (alum) as an endothermic fire retardant) is treated with 60 lbs/air dried metric ton of FR165 (phosphorus fire retardant, distributed by Cellulose Solutions) and 2 lbs/ton F60 surfactant (an ethoxylated alcohol surfactant, distributed by Eka Chemical). This treated fluff pulp is used in preparing an air-laid fibrous core which comprises 90% of the treated fluff pulp and 10% bicomponent PE/PE 6 mm diameter fibers (PE=polyethylene). The surfaces of this air-laid fibrous core are sprayed with a solution of a neutral pH endothermic fire retardant (Pre-Tec 3000 SF, a borosilicate endothermic fire retardant, distributed by Pre-Tec) at a 6% dose by weight of the core. The surface-treated air-laid fibrous core is tested according to the UL 94 HBF test method and passes this test without any after burn. The air-laid core has a pH of 6.9.

Example 2

A fluff pulp (which contains 20 lbs per ton of aluminum ammonium sulfate (alum) as an endothermic fire retardant) is treated with 60 lbs/air dried metric ton of FR165 phosphorus fire retardant and 2 lb/ton F60 surfactant. This treated fluff pulp is used in preparing an air-laid fibrous core which comprises 90% of the treated fluff pulp and 10% bicomponent PE/PE 6 mm fibers. The surfaces of this air-laid fibrous core are sprayed with a solution of a neutral pH blend of endothermic fire retardant and other (phosphorous) fire retardant (CS-FR 30-S, a silica and ammonium phosphate fire retardant distributed by Cellulose Solutions) at a 10% dose by weight of the core. The surface-treated air-laid fibrous core is tested according to the UL 94 HBF test method and passes this test without any after burn. The core has a pH of 6.9.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A process comprising the following steps:

a. providing an at least partially delignified pulp fiber web having a Kappa number of less than about 130; and b. treating the at least partially delignified pulp fiber web with an aqueous endothermic fire retardant solution having a pH of about 10 or less and comprising at least about 10% of one or more endothermic fire retardants based on the solids in the solution;

wherein the pulp fiber web treated with the endothermic fire retardant solution has a pH of from about 5 to about 9, wherein the pulp fiber web is treated with a total amount of endothermic fire retardants from at least about 20 lbs to about 250 lbs of endothermic fire retardants per ton of the pulp fiber web, and wherein at least about 5% of the total amount of endothermic fire retardants are added at a point prior to when the pulp fiber web is formed.

2. The process of claim 1, wherein the pulp fiber web of step (a) has a Kappa number of less than about 50.

3. The process of claim 1, wherein the pulp fiber web of step (a) comprises from about 50 to about 70% softwood pulp fibers and from about 30 to about 50% hardwood pulp fibers.

4. The process of claim 1, wherein the at least partially delignified pulp fiber web is treated in step (b) with an endothermic fire retardant solution having a pH of from about 5 to about 9.

5. The process of claim 4, wherein the endothermic fire retardant solution of step (b) has a pH of from about 6 to about 8.

6. The process of claim 1, wherein step (b) is carried out by adding an initial portion of from about 5 to about 33% of the total amount of endothermic fire retardants at a point prior to when the pulp fiber web is formed, and adding a remaining portion of from about 67 to about 95% of the total amount of endothermic fire retardants at a point after the pulp fiber web is formed.

7. The process of claim 6, wherein the remaining portion of step (b) is added after the pulp fiber web of step (a) is dried to a moisture content of about 10% or less.

8. The process of claim 7, wherein the remaining portion of step (b) is added after the pulp fiber web of step (a) is dried to a moisture content of about 7% or less.

9. The process of claim 7, wherein the remaining portion of step (b) is added by spraying a solution of endothermic fire retardant on the dried pulp fiber web.

10. The process of claim 9, wherein the dried pulp fiber web of step (a) is in the form of an air-laid fibrous structure.

11. The process of claim 7, wherein the initial portion of step (b) comprises a first type of endothermic fire retardant, and wherein the remaining portion of step (b) comprises a second type of endothermic fire retardant which is different from the first type of endothermic fire retardant.

12. The process of claim 1, wherein the endothermic fire retardants of step (b) comprise one or more of: boron-containing fire retardants; aluminum ammonium sulfate; magnesium silicate; aluminum hydroxide; and mixtures of calcium magnesium carbonate and hydrated magnesium carbonate hydroxide.

13. The process of claim 12, wherein the endothermic fire retardants of step (b) comprise one or more of: borosilicates; or aluminum ammonium sulfate.

14. The process of claim 1, wherein step (b) is carried out by treating the pulp fiber web with other fire retardants in an amount from about 10 to about 90% of the total fire retardants used to treat the pulp fiber web at a point after the pulp fiber web is formed.

15. The process of claim 14, wherein step (b) is carried out by treating the pulp fiber web with from about 40 to about 60% endothermic fire retardants and from about 40 to about 60% other fire retardants.

16. The process of claim 15, wherein the other fire retardants of step (b) comprise one or more of: phosphorous fire retardants, halogenated fire retardants, or metal oxide fire retardants.

17. The process of claim 16, wherein the other fire retardants of step (b) comprise one or more phosphorous fire retardants.

18. The process of claim 17, wherein the phosphorous fire retardants of step (b) comprise ammonium phosphate.

19. The process of claim 14, wherein step (b) is carried out by treating the pulp fiber web with one or more fire retardant distributing surfactants in an amount sufficient to distribute solely the other fire retardants in and/or on the pulp fiber web.

20. The process of claim 19, wherein step (b) is carried out by treating the pulp fiber web with one or more fire retardant distributing surfactants in an amount of from about 1 to about 10 lbs per ton of the pulp fiber web.

21. The process of claim 20, wherein the one or more fire retardant distributing surfactants of step (b) comprise one or more ethoxylated alcohols having from about 4 to about 25 ethylene oxide units and an alcohol carbon chain length of from about 12 to about 18 carbon atoms.

* * * * *